US011160407B2

(12) United States Patent
Omichinski

(10) Patent No.: US 11,160,407 B2
(45) Date of Patent: Nov. 2, 2021

(54) GARAGE FLOOR PROTECTION MAT FOR SNOWMOBILES AND THE LIKE

(71) Applicant: Ward Omichinski, Beausejour (CA)

(72) Inventor: Ward Omichinski, Beausejour (CA)

( * ) Notice: Subject to any disclaimer, the term of this patent is extended or adjusted under 35 U.S.C. 154(b) by 0 days.

(21) Appl. No.: 16/991,417

(22) Filed: Aug. 12, 2020

(65) Prior Publication Data

US 2021/0068572 A1 Mar. 11, 2021

(30) Foreign Application Priority Data

Sep. 11, 2019 (CA) ..... CA 3054997

(51) Int. Cl.
*E04H 6/42* (2006.01)
*A47G 27/02* (2006.01)

(52) U.S. Cl.
CPC ..... *A47G 27/0206* (2013.01); *E04H 6/428* (2013.01); *Y10T 137/5762* (2015.04); *Y10T 428/2457* (2015.01)

(58) Field of Classification Search
None
See application file for complete search history.

(56) References Cited

U.S. PATENT DOCUMENTS

2006/0008617 A1* 1/2006 Sourang ..... B32B 5/26 428/138

* cited by examiner

*Primary Examiner* — Alexander S Thomas
(74) *Attorney, Agent, or Firm* — Kyle R Satterthwaite; Ryan W Dupuis; Ade & Company Inc.

(57) ABSTRACT

A floor protection apparatus for use under parked snowmobiles or the like. The apparatus features a mat having longitudinally opposing first and second ends, and laterally opposing first and second sides. Longitudinally channeled areas reside respectively adjacent the sides of the mat at a topside thereof, and each feature a set of longitudinally running channels separated from one another by longitudinal ribs. One or more collection areas reside between the channeled areas at the topside of the mat and are of recessed elevation relative to the longitudinal ribs. A laterally ribbed central area resides between the first and second channeled areas and comprising a series of lateral ribs spaced from one another in the longitudinal direction. The mat is assembled from sections that fastened together through raised, abutted boundary edges.

20 Claims, 3 Drawing Sheets

18c/18d
18c/18d
18c/18d
18c/18d

GARAGE FLOOR PROTECTION MAT FOR SNOWMOBILES AND THE LIKE

CROSS-REFERENCE TO RELATED APPLICATIONS

This application claims benefit under 35 U.S.C. 119(a) of Canadian Patent Application No. 3,054,997, filed Sep. 11, 2019, the entirety of which is incorporated herein by reference.

FIELD OF THE INVENTION

The present invention relates generally to floor mats, and more specifically to floor mats intended to protect the floors of garages or other structures where snowmobiles or other vehicles are parked.

BACKGROUND

It has previously been proposed to protect garage floors from oil, melted snow, road salt or other material that may fall from parked vehicles and stain or damage the floor on which they are parked. However, there remains room for improvement, and applicant has designed a unique floor mat construction particularly well suited for snowmobiles, but also usable beneath other types of parked vehicles to protect the underlying floor of a garage or other parking site.

SUMMARY OF THE INVENTION

According to a first aspect of the invention, there is provided a floor protection apparatus comprising:

a mat having opposing first and second ends spaced apart from one another in a longitudinal direction, and opposing first and second sides spaced apart from one another in a lateral direction that lies perpendicularly transverse to said longitudinal direction;

first and second longitudinally channeled areas residing respectively adjacent the first and second sides of the mat at a topside thereof, each channeled area comprising a set of channels running in the longitudinal direction of the mat and separated from one another by longitudinal ribs defining sidewalls of said channels; and one or more collection areas residing between the first and second channeled areas at the topside of the mat and being of recessed elevation relative to the longitudinal ribs of said first and second channeled areas.

According to a second aspect of the invention, there is provided a floor protection apparatus comprising:

a mat having opposing first and second ends spaced apart from one another in a longitudinal direction, and opposing first and second sides spaced apart from one another in a lateral direction that lies perpendicularly transverse to said longitudinal direction;

first and second longitudinally channeled areas residing respectively adjacent the first and second sides of the mat at a topside thereof, each channeled area comprising a set of channels running in the longitudinal direction of the mat and separated from one another by longitudinal ribs defining sidewalls of said channels; and a laterally ribbed central area residing between the first and second channeled areas and comprising a series of lateral ribs that run in the lateral direction and are spaced from one another in the longitudinal direction.

According to a third aspect of the invention, there is provided a floor protection apparatus comprising:

a mat having opposing first and second ends spaced apart from one another in a longitudinal direction, and opposing first and second sides spaced apart from one another in a lateral direction that lies perpendicularly transverse to said longitudinal direction;

wherein said mat is assembled from a plurality of mat sections each spanning a partial length of the mat in the longitudinal direction, and each spanning a full width of the mat in the lateral direction; and wherein, among said plurality of mat sections, adjacent mat sections are secured together by fasteners engaged through abutted-together boundary edges of said adjacent mat sections.

According to a fourth aspect of the invention, there is provided a floor protection apparatus comprising:

a mat having opposing first and second ends spaced apart from one another in a longitudinal direction, and opposing first and second sides spaced apart from one another in a lateral direction that lies perpendicularly transverse to said longitudinal direction;

wherein said mat is assembled from a plurality of mat sections each spanning a partial length of the mat in the longitudinal direction, and each spanning a full width of the mat in the lateral direction; and wherein, among said plurality of mat sections, adjacent mat sections meet one another at abutted-together boundary edges where boundary walls of said adjacent mat sections are of raised elevation relative to floor surfaces of neighbouring areas of said adjacent mats sections, thereby forming a boundary between said floor surfaces of said adjacent mat sections.

BRIEF DESCRIPTION OF THE DRAWINGS

One embodiment of the invention will now be described in conjunction with the accompanying drawings in which.

DETAILED DESCRIPTION

Figure 1:
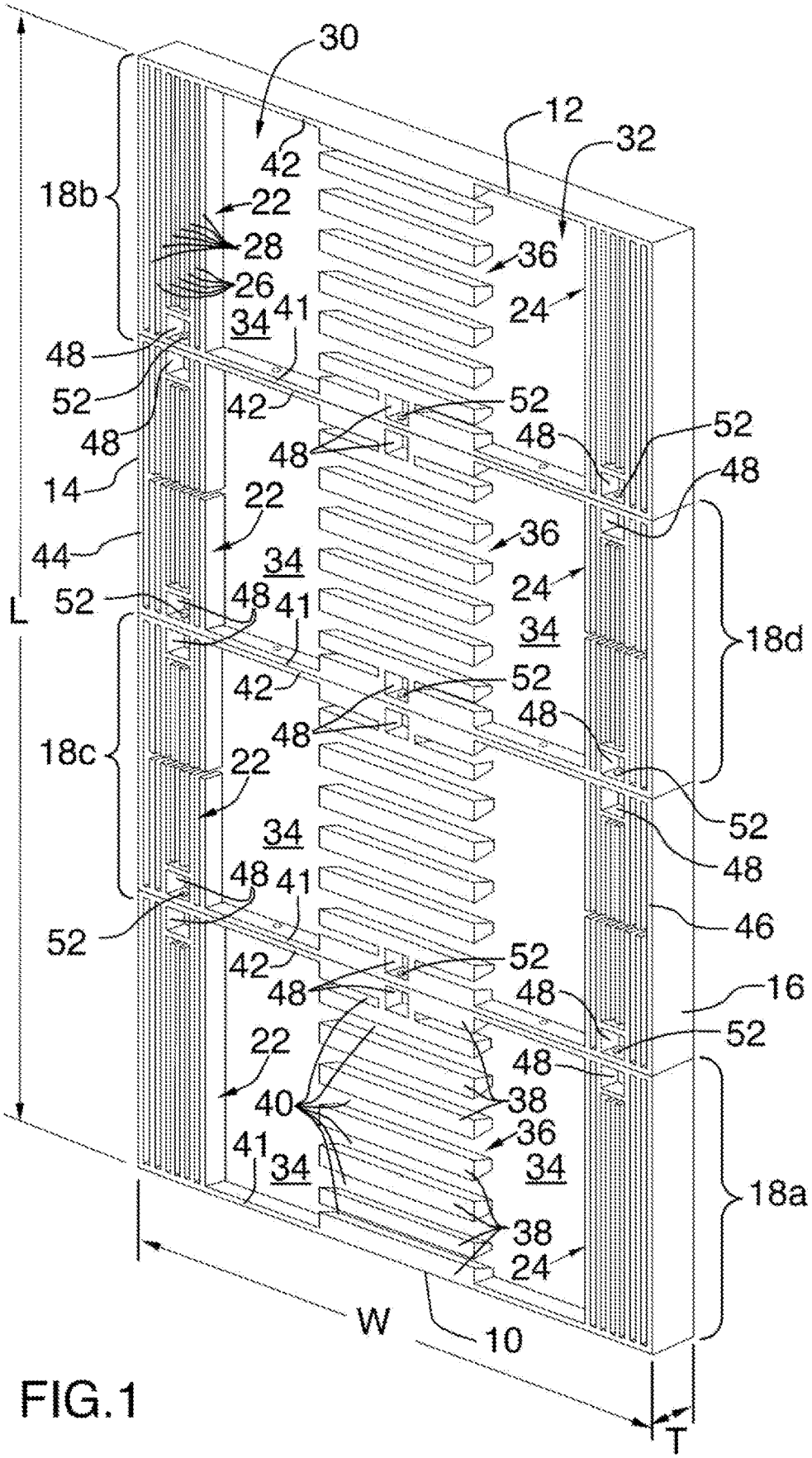
FIG. 1 is a top perspective view of a modular floor protection mat according to the present invention.
Figure 2:
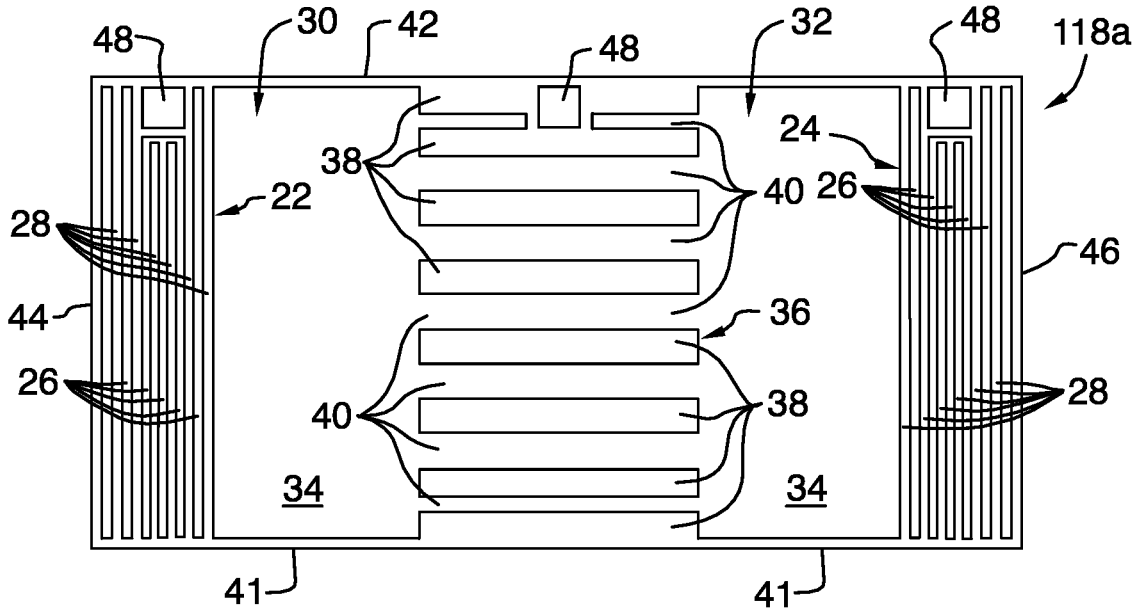
FIG. 2 is an isolated top plan view of an end section of the modular floor protection mat of FIG. 1.
Figure 3:
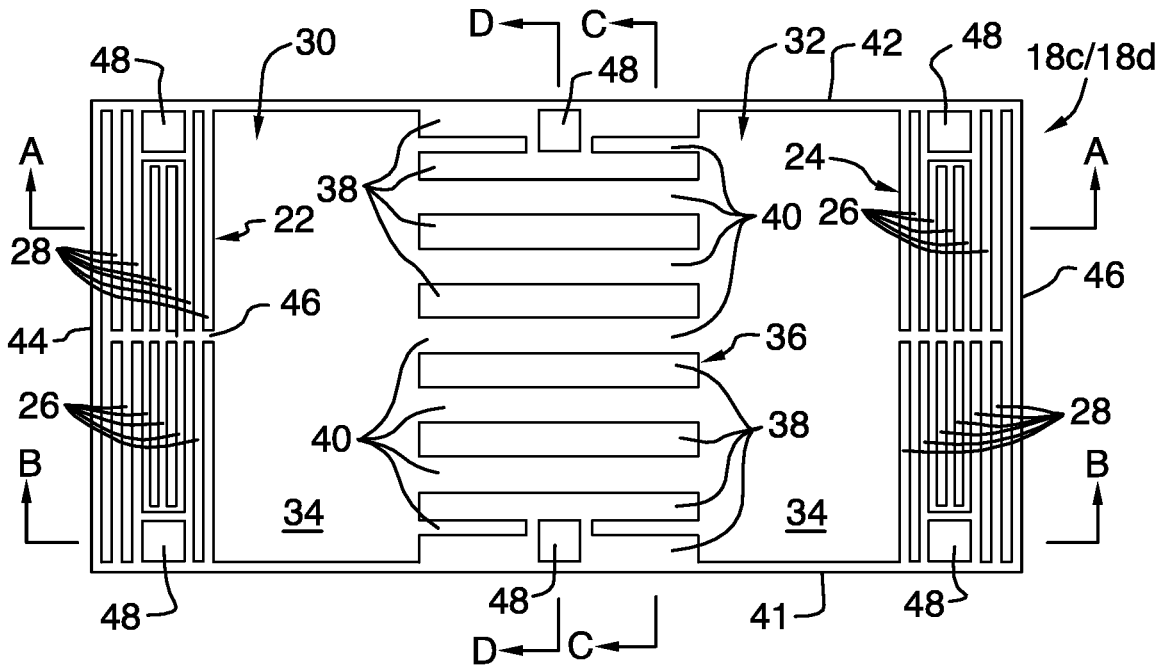
FIG. 3 is an isolated top plan view of a middle section of the modular floor protection mat of FIG. 1.

FIG. 1 illustrates a floor protection apparatus designed for particular compatibility with snowmobiles, though also useful for other similarly sized recreational vehicles such as ATV's, golf carts, go carts, dune buggies, etc. The apparatus features a modular mat assembled from a plurality of interconnectable mat sections, of which there are four in the illustrated example. The assembled mat has an overall length dimension L measured in a longitudinal direction between a first or front end 10 of the mat and an opposing second or rear end 12 thereof, and an overall width dimension W measured in a lateral direction perpendicularly transverse of the longitudinal direction from a first or left side 14 of the mat to an opposing second or right side 16 thereof. Each individual mat section spans the full overall width W of the mat, but only a fractional portion of the overall length dimension L of the mat. The assembled sections collectively span the overall length dimension of the mat, each preferably occupying an equal share thereof.

Each mat section thus defines a respective portion of the left and right sides of the mat, while the ends of the mat are respectively defined by only a particular two of the mat sections, which are therefore also referred to herein as end sections. Of these end sections, a first or front end section 18*a* defines the first or front end of the mat, while a second or rear end section 18*b* defines the second or rear end of the mat. In addition to the two end sections 18*a*, 18*b*, the illustrated example features two middle sections 18*c*, 18*d* installed between the two end sections, though it will be appreciated that the number of middle sections may be varied. The number of middle sections may be reduced to one or zero, or may be increased to any desired level according to the overall mat length required for a particular applicaiton. The width of each mat section, and the equal overall width of the assembled mat, mat is preferably between thirty-six and sixty inches, for example measuring forty-eight inches in one embodiment. The length of each mat section in the longitudinal direction is preferably between eighteen and thirty inches, for example measuring twenty-four inches in one embodiment. A thickness of the mat preferably is preferably less than two inches, for example measuring one inch in one embodiment, as measured at its point of greatest height profile.

The two end sections 18*a*, 18*b* are preferably identical to one another, and the middle sections are likewise identical to one another in preferred embodiments. With the exception of minor differences mentioned herein further below, the end sections and middle sections are otherwise of the same general construction. Each section is a singular unitary body of molded plastic whose underside may have a completely flat or other uniform configuration, as the underside merely resides atop the garage floor or other generally flat surface on which the mat is deployed for use. On the other hand, the topside of the mat section, lying opposite the underside in the thickness direction, has a non-uniform profile by which the topside is divided into a multitude of visually and tactilely distinct regions.

Identical first and second longitudinally channeled regions 22, 24 reside respectively adjacent the two sides of the mat section, and each feature a plurality of longitudinal channels 26 that run longitudinally of the mat. The longitudinal channels 26 are elevationally recessed relative to longitudinal ribs 28 that separate the longitudinal channels from one another and define sidewalls thereof. In the illustrated example, each channeled region features a total of five recessed channels 26, of which a middle three channels are slightly shorter than two outer channels disposed on opposite sides of the middle channels, for reasons outlined herein further below.

First and second collection regions 30, 32 reside respectively adjacent the channeled regions 22, 24 at the inner sides thereof nearest the center of the mat. Unlike the non-uniform profile of the alternating longitudinal ribs and channels in the channeled regions 22, 24, the collection regions 30, 32 have a uniformly flat floor 34 of lesser elevation than the raised ribs 28 of the channeled regions 22, 24. The width of each collection region 30, 32 in the lateral direction of the mat exceeds that of each channeled region 22, 24. The elevation of the flat floors 34 is equal to the floor of each longitudinal channel 26 of the channeled regions so that fluids collected in the longitudinal channels can freely flow into the larger neighbouring collection region. An innermost longitudinal rib of each longitudinally channeled region 22, 24 forms a boundary between the flat floor 34 of the collection region 30, 32 and the nearest longitudinal channel of the longitudinally channeled region.

Figures 5, 6, 7, 8:
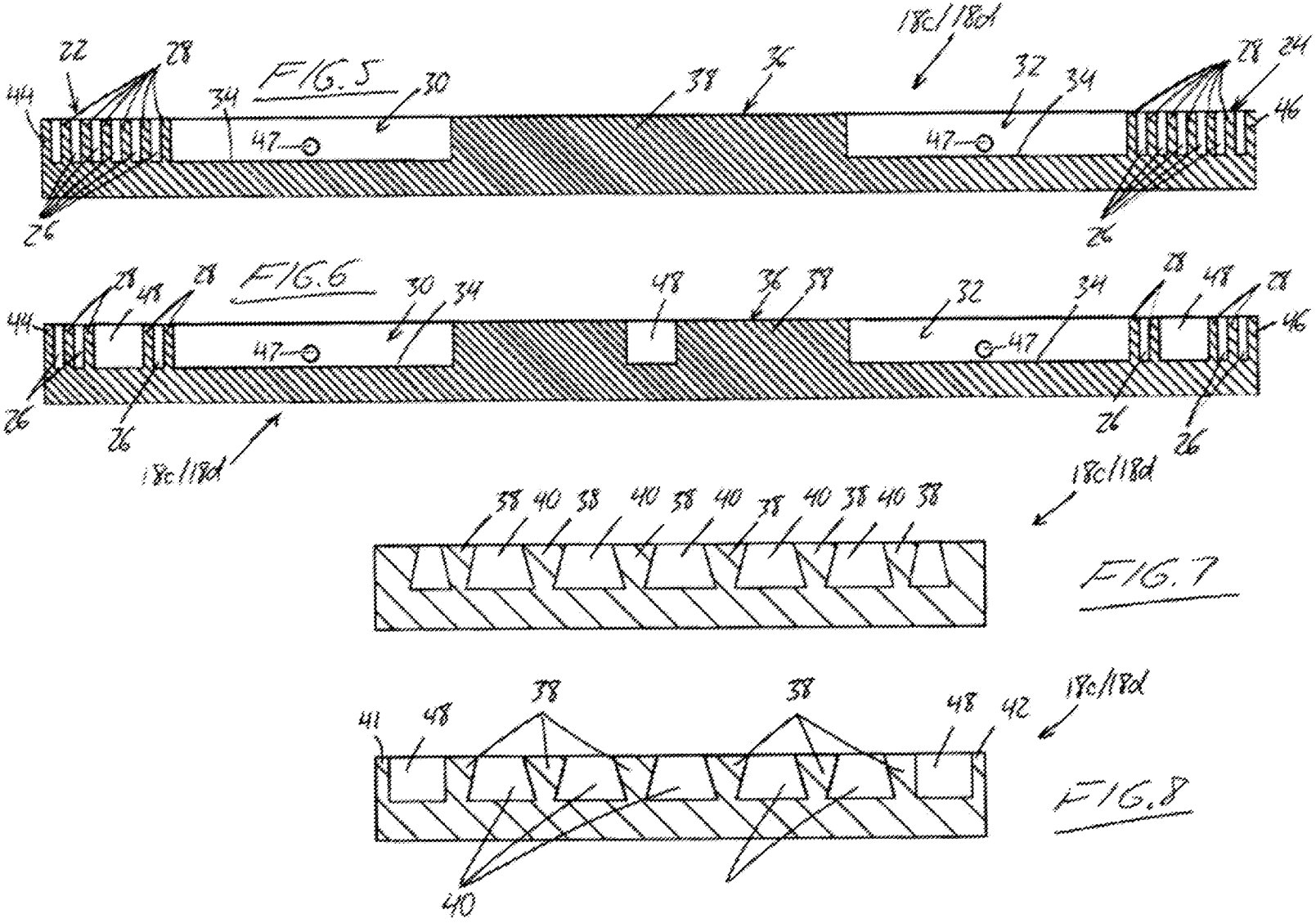
FIG. 5 is a cross-sectional view of the mat section of FIG. 3 as viewed along line A-A thereof.
FIG. 6 is a cross-sectional view of the mat section of FIG. 2 as viewed along line B-B thereof.
FIG. 7 is a cross-sectional view of the mat section of FIG. 3 as viewed along line C-C thereof.
FIG. 8 is a cross-sectional view of the mat section of FIG. 3 as viewed along line D-D thereof.

Finally, a laterally ribbed central region 36 of each mat section's topside resides between the two collection regions and features a plurality of lateral ribs 38 that run in the lateral direction of the mat and are spaced from one another in the longitudinal direction by parallel lateral channels 40 lying therebetween. The lateral ribs 38 and channels 40 of this central region 36 thus lie perpendicularly transverse to the longitudinal ribs 28 and channels 26 of the two longitudinally channeled regions 22, 24. As best shown in FIGS. 7 and 8, the lateral ribs 38 have a tapered profile in cross-sectional planes cutting vertically through the mat in the longitudinal direction thereof, for example having an inverted trapezoidal profile that is widest at the top of the rib 38 and narrows downwardly toward the floors of the lateral channels 40 that separate the lateral ribs from one another. The lateral channels 40 are thus upwardly tapered in inverse relation to the ribs 38, thus having a non-inverted trapezoidal profile that's widest at the channel floor and narrows toward the top ends of the lateral ribs 38. The two collection regions 30, 32 are collectively wider than the laterally ribbed central region 36 between them, through as shown, the laterally ribbed central region 36 may be narrower than each of the two collection regions 30, 32. The floors of the lateral channels are flush with the flat floors 34 of the collection regions to enable fluid to flow from the lateral channels 40 into the larger collection regions.

Each mat section has a set of four boundary walls spanning the full perimeter thereof, namely front and rear laterally-oriented boundary walls 41, 42 and left and right longitudinally oriented boundary walls 44, 46 that join with the front and rear boundary walls 41, 42 at the four corners of the rectangularly shaped mat section. Each boundary wall rises elevationally above the floors 34 of the collection regions, whereby the front and rear boundary walls 41, 42 block accumulated fluid in the collection region from spilling over the peripheral edges of the mat section. Each collection region thus forms an effective fluid collection basin on a respective side of the laterally ribbed central region.

On the first or front end section 18*a*, each longitudinal channel 26 and longitudinal rib 28 terminates short of the front boundary wall 41 so that these longitudinal channels have open front ends that drain into the neighbouring collection region, while the rear boundary wall 42 caps off the longitudinal channels 26 and ribs 28 at the rear ends thereof. Similarly, at the second or rear end section 18*b*, each longitudinal channel 26 and longitudinal rib 28 terminates short of the rear boundary wall 42 so that these longitudinal channels have open rear ends that drain into the neighbouring collection region, while the front boundary wall 42 caps off the longitudinal channels 26 and ribs 28 at the front ends thereof. On each middle section 18*c*, 18*d*, the longitudinal channels 26 and ribs 28 are instead divided into front and rear halves by a central gap or break 46 that lies flush with the floor of the neighbouring collection region to form a laterally-oriented drainage path into that collection region. The front channel halves located between the break 46 and the front boundary wall 41 are capped off at the front end of the section by the front boundary wall 41, while the rear channel halves located between the break 46 and the rear boundary wall 42 are capped off at the rear end of the section by the rear boundary wall 42.

To assemble the mat, the mat sections are abutted end-to-end, i.e. with the laterally oriented front boundary wall 41 of one section abutted against the laterally oriented rear boundary wall 42 of the next section. The mat sections are aligned so that the left and right boundary walls lie flush with another. In this aligned state of the mat section, the longitudinally channeled regions 22, 24 of the different mat sections align with one another form longitudinally channeled areas of the overall mat that span substantially the entire overall length L thereof. Likewise, the laterally ribbed central regions 36 of the different mat sections align with one another form a laterally ribbed central area of the overall mat that spans substantially the entire overall length thereof. Likewise, the collection regions 30, 32 of the different mat sections align with one another form collection areas of the overall mat that span substantially the entire overall length thereof.

The overall collection area is substantially subdivided into the respective collection regions 30, 32 of the different mat sections by the abutted-together front and rear boundary walls 41, 42 of the adjacent mat sections. Likewise, the closure of the longitudinal channels 26 at the abutted-together front and rear walls 41, 42 of the assembled mat sections prevent fluid flow from the longitudinally channeled region of one mat section to the next.

However, in order to maximize the water capacity of the assembled mat, the collection regions of the different mat sections are fluidly communicated with one another by flow-through bores 47 in the front and rear boundary walls 41, 42 each middle section 18*c*, 18*d* and in the rear and front wall of the front and rear end sections 18*a*, 18*b*, respectively. The flow-through bores 47 penetrating the rear wall 42 of the middle mat sections 18*c*/18*d* above the floors of the collection regions can bee seen in the cross-sectional views of FIGS. 5 and 6. At least one such flow-through bore 47 passes through the front or rear boundary wall of the mat section at each of the collection regions 30, 32 thereof, and aligns with a corresponding flow-through bore 47 in the neighbouring rear or front boundary wall of the neighbouring mat section. As a result, abutment of these boundary walls of the neighbouring mat sections against one another places these two flow-through bores in mated end-to-end relation cooperatively defining a flow-through passage from the collection region of one mat section to the matching collection region of the neighbouring mat section. An o-ring is preferably seated in an enlarged/counter-bored end region of one of every pair of matable flow-through bores at the outer side of the respective boundary wall to ensure a fluid-tight state of the resulting flow-through passage when the boundary walls of the neighbouring mat sections abutted against one another. Each flow-through passage may be lined with a short length of pipe To ensure the assembled mat sections remain in tightly abutted relation to one another, thereby ensuring compression of the o-rings to prevent leakage from the collection regions, fasteners are used to couple the adjacent mat sections together through their abutted boundary walls. For such purpose, fastener-accommodating cavities 48 are provided in each mat section at an inner side of one or both of the laterally-oriented boundary walls 41, 42 at discretely spaced positions therealong. The illustrated example places such cavities 48 at of the longitudinally channeled regions 22, 24 and laterally ribbed central region 36 of the mat section.

The first or front end section 18*a* has cavities 48 only at the rear boundary wall 42 thereof since no neighbouring mat section resides adjacent the front boundary wall 41 of this front end section 18*a*. At each of the longitudinally channeled regions 22, 24 of the front end section 18*a*, the respective cavity 48 resides between the rear boundary wall 42 and the shorter inner channels that stop short of the rear boundary wall 42, and between the longitudinal ribs 28 that neighbour the cavity 48 on either side and separate the longer outer channels from the shorter inner channels. Still referring to the front end section 18*a*, the cavity 48 at the laterally ribbed central region 36 interrupts the lateral rib that resides nearest to and integrally joins with the rear boundary wall 42, and as shown, may also interrupt the neighbouring lateral channel on the side of this rib opposite the rear boundary wall, thus dividing this channel into two separate left and right halves.

The second or rear end section 18*b* is of mirrored relation to the first end section 18*a*, for example being of identical construction but merely rotated 180-degrees into mirrored orientation thereto at the opposite end of the mat. Accordingly, the second or rear end section 18*b* has cavities 48 only at the front boundary wall 41 thereof since no neighbouring mat section resides adjacent the rear boundary wall 42 of this rear end section 18*b*. At each of the longitudinally channeled regions 22, 24 of the rear end section 18*b*, the respective cavity 48 resides between the front boundary wall 41 and the shorter inner channels that stop short of the front boundary wall 41, and between the longitudinal ribs that neighbour the cavity 48 on either side and separate the longer outer channels from the shorter inner channels. Still referring to the rear end section 18*b*, the cavity 48 at the laterally ribbed central region 36 interrupts the lateral rib that resides nearest to and integrally joins with the front boundary wall 41, and as shown, may also interrupt the neighbouring lateral channel on the side of this rib opposite the front boundary wall, thus dividing this channel into two separate left and right halves.

Each middle section 18*c*, 18*d* has two sets of cavities 48, each residing adjacent a respective one of the front and rear boundary walls 41, 42 thereof. One set of cavities thus reside in the same relative positions as the cavities of the front end section 18*a*, while the other set of cavities resides in the same relative positions as the cavities of the rear end section 18*b*.

Figure 4:
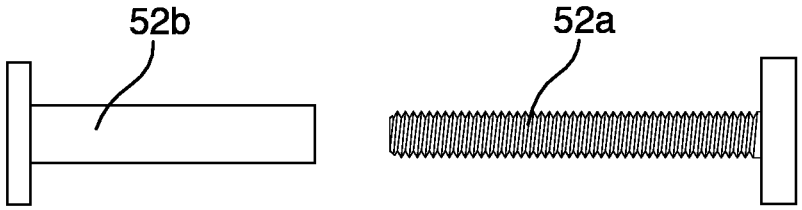
FIG. 4 is an isolated view of one of the fasteners used to interconnect the sections of the modular floor protection mat of FIG. 1.

With reference to FIG. 4, each fastener comprises a male fastener element 50, for example an Allen key bolt with an externally threaded shaft 50*a* and a hexagonal socketed head 50*b*, and a mating female fastener element 52, for example an Allen key cylindrical nut with an internally threaded cylinder 52*a* and a hexagonally socketed head 52*b*. Use of Allen key fasteners enables use of an L-shaped Allen key to access to the fastener elements within the cavities 48, but it will be appreciated that other fasteners of other drive type may alternatively be employed. At each cavity 48, a fastener-accommodating hole through the respective boundary wall 41, 42 is provided so that the male and female fastener elements 50, 52 can be mated together through the aligned holes in the abutted-together boundary walls 41, 42 of the adjacent mat sections, whereupon tightening of the fastener secures these boundary walls 41, 42 in such abutted relation to hold the adjacent mat sections together.

The width of the longitudinally channeled areas of the mat and the spacing therebetween is selected so that these areas will underlie the skis of most or all commercially available snowmobile models, while the drive tread of the snowmobile centered between the snowmobile skis will overlie the laterally ribbed central area of the mat. The carbide runners on the undersides of the snowmobile skis sill slip into the longitudinal channels 26 of the longitudinally channeled areas as the snowmobile is driven onto the mat at the front end 10 thereof, whereupon the engagement of the runners in the longitudinal channels 26 will help guide the snowmobile straight along the mat as the non-runnered areas of the ski's underside ride over the longitudinal ribs 28 of these longitudinally channeled areas of the mat.

As the drive tread of the snowmobile drives over the front end 10 of the mat onto the laterally ribbed central area thereof, the lateral ribs give the tread something to push rearwardly against to drive the snowmobile further onto the mat toward the rear end thereof. The downwardly tapered shape of the lateral ribs creates an undercut beneath the top end of the lateral rib, by which the drive tread can better catch an upper corner of the rib and push thereagainst the drive the snowmobile along the ramp. The number of mat sections used to assemble the mat is sufficient to underlie the entirety of the snowmobile once parked thereon, or to underlie two or more snowmobiles parked in series, or to form an elongated approach over which the snowmobile can drive into a final parking destination to reduce or avoid travel of the snowmobile over unprotected floor space to reach said parking destination. The longitudinal and lateral channels in the longitudinally channeled and laterally ribbed areas can collect melting snow, which then drains into the larger basin space provided by the recessed collection regions, thus preventing water and ice buildup on the garage floor.

While the described embodiment is particularly suitable for snowmobiles, it will be appreciated that the same mat can similarly be used for other vehicle types to prevent melted snow, leaking vehicle fluids or any other debris from soiling the floor of a garage, trailer or other parking site. The modular design allows space efficient flat-pack shipping and storage of the mat sections in stacked relation atop one another. Though the illustrated embodiment uses distinct end sections where the fastening cavities 48 are omitted at one end, other embodiments may employ identical mat sections throughout. However, the illustrated configuration of the end sections may be beneficial in that having middle channels of each longitudinally channeled region of the mat open at their front ends on the front end section may better encourage the runners into the longitudinal channels as the snowmobile first drives onto the mat at the front end thereof.

Since various modifications can be made in my invention as herein above described, and many apparently widely different embodiments of same made, it is intended that all matter contained in the accompanying specification shall be interpreted as illustrative only and not in a limiting sense.

The invention claimed is:

1. A floor protection apparatus comprising:

a mat having opposing first and second ends spaced apart from one another in a longitudinal direction, and opposing first and second sides spaced apart from one another in a lateral direction that lies perpendicularly transverse to said longitudinal direction;

first and second longitudinally channeled areas residing respectively adjacent the first and second sides of the mat at a topside thereof, each channeled area comprising a set of longitudinal channels running in the longitudinal direction of the mat and separated from one another by longitudinal ribs defining sidewalls of said longitudinal channels; and one or more collection areas residing between the first and second longitudinally channeled areas at the topside of the mat and being of recessed elevation relative to the longitudinal ribs of said first and second longitudinally channeled areas;

wherein said one or more collection areas comprises first and second collection areas that reside respectively adjacent the first and second longitudinally channeled areas and are separated from one another by a laterally ribbed central area comprising a series of lateral ribs that run in the lateral direction, are spaced from one another in the longitudinal direction, and are of greater elevation than the first and second collection areas.

2. The apparatus of claim 1 wherein said lateral ribs of the laterally ribbed central area are of downwardly-narrowing profile in cross-sectional planes lying longitudinally of the mat.

3. The apparatus of claim 1 wherein said laterally ribbed central area comprises lateral channels delimited between said lateral ribs, and a width of each of said first and second collections areas, measured between said laterally ribbed central area and the respectively adjacent one of the first and second longitudinally channeled areas, exceeds a respective width of both each longitudinal channel and each lateral channel.

4. A floor protection apparatus comprising:

a mat having opposing first and second ends spaced apart from one another in a longitudinal direction, and opposing first and second sides spaced apart from one another in a lateral direction that lies perpendicularly transverse to said longitudinal direction; and first and second longitudinally channeled areas residing respectively adjacent the first and second sides of the mat at a topside thereof, each channeled area comprising a set of longitudinal channels running in the longitudinal direction of the mat and separated from one another by longitudinal ribs defining sidewalls of said longitudinal channels;

wherein:

said mat is assembled from a plurality of mat sections each spanning a partial length of the mat in the longitudinal direction, each spanning a full width of the mat in the lateral direction; and the mat is further characterized by one or more of the following features:

(a) one or more collection areas residing between the first and second channeled areas at the topside of the mat and being of recessed elevation relative to the longitudinal ribs of said first and second channeled areas; and (b) a laterally ribbed central area residing between the first and second channeled areas and comprising a series of lateral ribs that run in the lateral direction and are spaced from one another in the longitudinal direction.

5. The apparatus of claim 4 wherein, among said plurality of mat sections, adjacent mat sections are secured together by fasteners engaged through abutted-together boundary edges of said adjacent mat sections.

6. The apparatus of claim 4 wherein the mat is characterized by inclusion of feature (a), and, among said plurality of mat sections, adjacent mat sections meet one another at abutted-together boundary edges where boundary walls of said adjacent mat sections are of raised elevation relative to respective portions of the one or more collection areas, whereby said boundary walls subdivide the one or more collection areas into separate collection regions respectively defined on the adjacent mat sections.

7. The apparatus of claim 6 comprising aligned flow-through openings penetrating the boundary walls of said adjacent mat sections at the abutted-together boundary edges thereof to cooperatively define flow-through passages fluidly communicating the collection regions of said adjacent mat sections with one another.

8. The apparatus of claim 4 wherein the mat is characterized by inclusion of feature (b).

9. The apparatus of claim 4 wherein, among said plurality of mat sections, adjacent mat sections meet one another at abutted-together boundary edges where boundary walls of said adjacent mat sections are of raised elevation relative to floor surfaces of neighbouring regions of said adjacent mats sections, thereby forming a boundary between said floor surfaces of said adjacent mat sections.

10. The apparatus of claim 9 comprising aligned flow-through openings penetrating the boundary walls of said adjacent mat sections at the abutted-together boundary edges thereof to cooperatively define flow-through passages through the boundary between the floor surfaces.

11. The apparatus of claim 4 wherein the mat is characterized by inclusion of at least feature (a).

12. The apparatus of claim 11 wherein a width of each collection area, measured in the lateral direction, exceeds a width of each longitudinal channel.

13. The apparatus of claim 4 wherein the mat is characterized by inclusion of both feature (a) and feature (b).

14. The apparatus of claim 13 wherein said laterally ribbed central area comprises lateral channels delimited between said lateral ribs, and a width of each collections area, measured in the lateral direction, exceeds a respective width of both each longitudinal channel and each lateral channel.

15. In combination, a snowmobile and a floor protection apparatus comprising:

a mat having opposing first and second ends spaced apart from one another in a longitudinal direction, and opposing first and second sides spaced apart from one another in a lateral direction that lies perpendicularly transverse to said longitudinal direction; and first and second longitudinally channeled areas residing respectively adjacent the first and second sides of the mat at a topside thereof, each channeled area comprising a set of longitudinal channels running in the longitudinal direction of the mat and separated from one another by longitudinal ribs defining sidewalls of said longitudinal channels;

wherein:

the longitudinally channeled areas of the mat are positioned to underlie skis of said snowmobile so that runners of said skis are received in the longitudinal channels of the channeled areas when said snowmobile is driven onto said mat; and the mat is further characterized by one or more of the following features:

(a) one or more collection areas residing between the first and second channeled areas at the topside of the mat and being of recessed elevation relative to the longitudinal ribs of said first and second channeled areas; and (b) a laterally ribbed central area residing between the first and second channeled areas and comprising a series of lateral ribs that run in the lateral direction and are spaced from one another in the longitudinal direction.

16. The combination of claim 15 wherein the mat is characterized by inclusion of at least feature (b), and the laterally ribbed central area of the mat and the longitudinally channeled areas of the mat are positioned to respectively underlie a drive tread and skis of said snowmobile so that when said snowmobile is driven onto said mat, runners of said skis are received by the longitudinal channels while the drive tread runs over the laterally ribbed central area.

17. The combination of claim 15 wherein the mat is characterized by inclusion of at least feature (a).

18. The combination of claim 17 wherein a width of each collection area, measured in the lateral direction, exceeds a width of each longitudinal channel.

19. The combination of claim 15 wherein the mat is characterized by inclusion of both feature (a) and feature (b).

20. The combination of claim 19 wherein said laterally ribbed central area comprises lateral channels delimited between said lateral ribs, and a width of each collections area, measured in the lateral direction, exceeds a respective width of both each longitudinal channel and each lateral channel.

* * * * *